US008501381B2

(12) United States Patent
Humpert et al.

(10) Patent No.: US 8,501,381 B2
(45) Date of Patent: Aug. 6, 2013

(54) LIQUID DEVELOPER COMPOSITION AND METHOD OF ITS PREPARATION

(75) Inventors: Hans-Josef Humpert, Lippstadt (DE); Serge Tavernier, Lint (BE); Kerstin Hymon, Witten (DE)

(73) Assignee: Hologi Hitec-Imaging GmbH, Warstein (DE)

( * ) Notice: Subject to any disclaimer, the term of this patent is extended or adjusted under 35 U.S.C. 154(b) by 710 days.

(21) Appl. No.: 12/531,919

(22) PCT Filed: Mar. 19, 2008

(86) PCT No.: PCT/EP2008/002214

§ 371 (c)(1),
(2), (4) Date: Sep. 21, 2009

(87) PCT Pub. No.: WO2008/113582

PCT Pub. Date: Sep. 25, 2008

(65) Prior Publication Data

US 2010/0068478 A1 Mar. 18, 2010

(30) Foreign Application Priority Data

Mar. 20, 2007 (EP) ..... 07005667

(51) Int. Cl.
*G03G 9/13* (2006.01)

(52) U.S. Cl.
USPC ..... 430/114; 430/137.18

(58) Field of Classification Search
USPC ..... 430/114, 112–118.7, 137.18
See application file for complete search history.

(56) References Cited

U.S. PATENT DOCUMENTS

| | | | | |
|---|---|---|---|---|
| 5,395,724 | A * | 3/1995 | Morrison et al. | 430/114 |
| 5,607,808 | A | 3/1997 | Nishizawa et al. | |
| 7,351,511 | B2 * | 4/2008 | Kurokawa et al. | 430/118.7 |
| 2005/0244736 | A1 | 11/2005 | Yon et al. | |

FOREIGN PATENT DOCUMENTS

| | | | |
|---|---|---|---|
| EP | 0 455 343 | A | 11/1991 |
| EP | 0 605 108 | A | 7/1994 |
| EP | 1 607 799 | A | 12/2005 |
| JP | 61 156261 | A | 7/1986 |
| JP | 61 156263 | A | 7/1986 |
| JP | 61 156264 | A | 7/1986 |
| JP | 62 018575 | A | 1/1987 |
| JP | 62 098364 | A | 5/1987 |
| JP | 62 115171 | A | 5/1987 |
| JP | 3119364 | A | 5/1991 |
| WO | WO 2007/018503 | | 2/2007 |

* cited by examiner

*Primary Examiner* — Jonathan Jelsma
(74) *Attorney, Agent, or Firm* — Chalin A. Smith; Smith Patent Consulting

(57) ABSTRACT

The invention relates to a liquid developer composition comprising a dispersant, and toner particles dispersed in said dispersant. The liquid developer composition can be used for printing onto a substrate. The binder resin in the toner particles is curable, e.g. by UV-light.

24 Claims, No Drawings

LIQUID DEVELOPER COMPOSITION AND METHOD OF ITS PREPARATION

This application corresponds to the national phase of International Application No. PCT/EP2008/002214 filed Mar. 19, 2008, which, in turn, claims priority to European Patent Application No. 07.005667.6 filed Mar. 20, 2007, the contents of which are incorporated by reference herein in their entirety.

FIELD OF THE INVENTION

The present invention relates to a liquid developer composition comprising a dispersant and toner particles dispersed in said dispersant. The developer composition is curable, in particular radiation curable. The present invention further relates to a method of preparing such composition and a substrate being imprinted using such composition.

BACKGROUND OF THE INVENTION

In imaging methods like electro(photo)graphy, magnetography, ionography, etc. a latent image is formed which is developed by attraction of so-called toner particles. Afterwards the developed latent image (toner image) is transferred to a final substrate and fused to this substrate. In direct electrostatic printing (DEP) printing is performed directly from a toner delivery means on a receiving substrate by means of an electronically addressable print head structure.

Toner particles are basically polymeric particles comprising a polymeric resin as a main component and various ingredients mixed with said toner resin. Apart from colorless toners, which are used e.g. for finishing function, the toner particles comprise at least one black and/or coloring substance, e.g., colored pigment.

In toner development of latent electrostatic images two techniques have been applied: "dry", powder development and "liquid" dispersion development. Dry powder development is nowadays most frequently used.

In dry development, the application of dry toner powder to the substrate carrying the latent electrostatic image or the latent magnetic image may be carried out by different methods, including cascade, magnetic brush, powder cloud, impression, and transfer or touch down development methods. In liquid development, the toner particles are suspended in an insulating liquid, both constituents forming together the so-called liquid developer. During the development step, the toner particles are deposited image-wise on the latent electrostatic image-bearing carrier or the latent magnetic image-bearing carrier by electrophoresis (under the influence of electrical fields) or magnetophoresis (under the influence of magnetic fields). In these particular development steps, the toner particles have, respectively, an electrical charge or a magnetization.

Recent progress in digital printing methods makes considerations such as cost per copy, layer thickness of the marking material, resolution, and speed of imaging extremely important. In this respect, liquid toner systems have marked advantages over dry toner imaging techniques because the imaging particles are much smaller in size (compared to dry toner particles) and are comparable in size to typical conventional ink layer thicknesses. A liquid toner composition is for example disclosed in EP-A-1 341 053.

The visible image of electrostatically or magnetically attracted toner particles is not permanent and has to be fixed. Fixing is accomplished by causing the toner particles to adhere to the final substrate by softening or fusing them, followed by cooling. Typically, fixing is conducted on substantially porous paper by causing or forcing the softened or fused toner mass to penetrate into the surface irregularities of the paper.

There are different types of processes used for fusing a toner image to its final substrate. Some are based on fusing by heat, others are based on softening by solvent vapors, and others by the application of cold flow at high pressure under ambient temperature conditions. After the operation of being produced, the toner images further have to withstand some external forces applied during the subsequent treatments. The problems associated with multiple, superimposed layers of toner particles that are in one way or another fixed on a substrate are manifold, not only with respect to image quality but also with respect to image stability and with respect to mechanical issues.

An example of high mechanical impact on the toner layers is the sorting of printed papers. The fast turning wheels of a sorting machine can give a temperature increase above the glass transition temperature (Tg) of the resin used, that can cause contamination with pigmented toner resin on the next coming papers. Another application where the heat and mechanical resistance of the toner layer is stressed is the production of e.g. car manuals.

When the temperature inside the car rises above the Tg of the toner resin (e.g. when parked in the sun), the papers in the manual can stick to each other.

In the case of printing packaging materials with the use of toner technology, increased temperatures are met in many ways. Plastic can be used as a substrate and bags made out of it with the use of a sealing apparatus. If the sealing temperature is above the Tg of the toner resin used, the toner images get disturbed.

For a lot of these applications, a toner resin with a higher Tg should be used, but then the amount of energy necessary to fuse the toner particle onto the substrate would be so high that the application is energetically not interesting anymore. Furthermore, a lot of substrates can't be used anymore. High Tg toners exist already, but the demand for high speed engines increases the demand for toner particles which can be fused at normal fusing temperatures at a very high speed.

A lot of new applications are emerging. Especially in the pharmaceutical and in the food industry, there is an increased need for correct product information and for traceability. Product information related to expiration date, origin of the product, batch number is becoming more and more important. This induces the need for variable data printing down to the level of single items. Information is not only to be printed on the overall packaging, but also on the individual wrap. The printed data should be erase proof. Curable toner would offer an interesting concept.

The toxicity of a reactive and curable system however imposes limitations. In the case of dry curable toner technology, all components are contained within the toner particles, reducing the migration of toxic components. Liquid curable toners would however be more interesting as they enable to print at higher resolution and at lower cost. However the migration of the active components in liquid curable toners is an issue.

Adding curable additives or the use of a curable dispersant for the liquid toner is not suited, especially in applications involving food, pharmaceuticals, etc. Thermal curability is also not so suited, since it occurs at higher temperatures and involves long residence times, prohibiting printing on the product as such and or the use of temperature sensitive packaging material. In this sense UV curability is more suited than thermal curability, however with the restriction that the active components are to be not free to dissolve or migrate.

From the discussion it is obvious that there is a need for a low temperature, UV curable liquid toner, showing no migration of the active components, nor having presence of active components in the dispersant.

Radiation curable dry toners as known for example from EP-A-1 437 628 and WO 2005/116778. In these toners the resin is cured either in-line, e.g. at the time of fusing the toner to a substrate or off-line, e.g. after fusing the toner to a substrate. Curing of the resin can be conducted by radiation, such as UV-radiation, electron beam or chemically. By curing the resin the toner becomes permanently fixed to the substrate and the problems associated with non-curable toners in particular when the printed substrates are used under high temperature conditions are met.

In view of the above described advantages of liquid toner systems over dry toner systems there is, however, still a need for an improved curable liquid developer composition. Unfortunately, to provide a curable liquid developer composition turned out to be difficult because the required initiator may dissolve in the liquid dispersant and the polymeric dispersing agent which assists the dispersion of the toner particles in the dispersant may hinder the cross-linking of the toner particles. Thus, there is still a need to provide a radiation curable liquid toner which can be fixed at low temperatures but which is resistant to high temperatures once printed while maintaining all the other properties necessary to function correctly in a printer.

SUMMARY OF THE INVENTION

It has now surprisingly been found that the above objects are met by the liquid developer composition of the present invention. Thus, the present invention relates to a liquid developer composition, comprising a dispersant, a polymeric dispersing agent and toner particles dispersed in said dispersant, wherein the toner particles comprise a binder resin comprising a polymeric composition being able to be cured by actinic radiation, an initiator, and a coloring substance, and wherein the constituents of the toner particles are substantially insoluble in the dispersant.

Also provided is a method of preparing a liquid developer composition which comprises the steps of a) preparing a conglomerate comprising a binder resin comprising a polymeric composition being able to be cured by actinic radiation, an initiator, and a coloring substance, b) grinding said conglomerate, c) dispersing said grinded conglomerate in a dispersant, and d) further grinding said dispersion.

The liquid developer composition is suited for making color images with good image quality and good color characteristics and in particular for making color images that are resistant to high temperatures. Thus, the present invention also provides a substrate being imprinted using a liquid developer composition of the present invention.

DETAILED DESCRIPTION OF THE INVENTION

One of the above described problems in the preparation of curable liquid developer compositions is the solubility of one or more of the constituents of the toner particles in the liquid dispersant. While this invention provides several options to overcome this problem it has surprisingly been found that a particularly suitable liquid developer composition is obtained if the binder resin forms a matrix and the constituents, such as the initiator and the coloring substance are dispersed throughout said matrix.

Another option to avoid the problems associated with curable liquid developer compositions is to select the constituents of the toner particles such that they are substantially insoluble in the dispersant. For the present application "substantially insoluble" is defined by a solubility of lower than 1 g/l with respect to each of the constituents taken alone.

A further option to overcome the problems associated with curable liquid developer compositions is to carefully select the polymeric dispersing agent used to disperse the toner particles in the dispersant and the amount of said polymeric dispersing agent. This will be described in further detail below.

In the composition of the present invention only the toner particles are curable. In other words, neither the dispersant nor the polymeric dispersing agent have to be curable.

In order to make the developer composition curable the toner particles must comprise a binder resin comprising a polymeric composition being able to be cured by actinic radiation.

In the present invention the term "actinic radiation" is understood to cover any kind of electromagnetic radiation, such as IR-radiation, visible light, UV-light, and γ-radiation, as well as particle beams, such as electron beams.

Any polymeric compound having at least two active groups, said groups being able to be activated by the actinic radiation, may be employed. In the present invention the term "active groups" designates chemical groups at the end of a polymeric chain as well as chemical groups being attached at any position of the polymeric chain (so called "pending groups"), such as any position of the polymeric backbone.

Useful radiation curable compounds are UV curable epoxy resins. Other useful UV curable compounds are polymeric compounds having at least two ethylenically unsaturated groups. Preferably, the polymeric compound having at least two ethylenically unsaturated groups comprises a polyester resin. Any combination of one or more radiation curable compositions may be employed. The toner particles in the liquid developer composition of the present invention may comprise the polymeric radiation curable composition as a sole resin, or the polymeric radiation curable composition may be mixed with other binder resins. In that case any binder resin known in the art may be useful for the production of toner particles in the liquid developer composition of the present invention. The resins mixed with the radiation curable composition can be for example polycondensation polymers (e.g. polyesters, polyamides, co-(polyester/polyamides), etc.), epoxy resins, addition polymers or mixtures thereof.

In one embodiment of the present invention the binder resin including the polymeric composition is substantially amorphous, preferably totally amorphous.

Although electron beam curable compounds can be used in the present invention, the curable groups are preferably cured by electromagnetic radiation, more preferably by UV-light.

Useful UV-curable polymeric compounds having at least two ethylenically unsaturated groups for incorporation in toner particles are resins based on (meth)acrylate containing polyesters. The term polyester includes all polymers with a backbone structure based on a polycondensation of an alcohol, preferably one or more polyols having 2 to 5 hydroxyl groups, and a carboxylic acid-containing compound. Examples of such UV-curable resins are unsaturated polyesters based on terephthalic and/or isophthalic acid as the carboxylic acid-containing component, and on neopentylglycol and/or trimethylolpropane as the polyol component and whereon afterwards an epoxy-acrylate such as glycidyl (meth)acrylate may be attached. Such polymers are available for instance from Cytec Surface Specialities under the trade name Uvecoat. Another UV-curable resin is a polyester-urethaneacrylate polymer which may be obtained by the reaction of an hydroxyl-containing polyester, a polyisocyanate and a hydroxyacrylate. Another binder system useful in the present invention is composed of a mixture of an unsaturated polyester resin in which maleic acid or fumaric acid is incorporated and a polyurethane containing a vinylether available from DSM Resins under the trade name Uracross.

The liquid developer composition of the present invention may optionally further comprise a cross-linker in the toner particles. The cross-linker preferably has a functionality of at least 3. Generally the cross-linker has a molecular weight lower than the molecular weight of the polymeric composition being able to be cured by actinic radiation.

As a further essential component the toner particles in the liquid developer composition of the present invention comprise an initiator which is able to initiate cross-linking and, thus, curing of the toner particles. The initiator can be selected such that the toner particles can be cured by electron beam or electromagnetic radiation, preferably UV-light. In a preferred embodiment the initiator is a photoinitiator, preferably a photoinitiator that can be activated by UV-radiation. Very useful photoinitiators in the context of this invention include, but are not limited to, compounds such as shown in the formulae I, II and III below, or mixtures of these compounds. Commercially available photoinitiators are available from Ciba Geigy under the trade name Irgacure.

Compound I

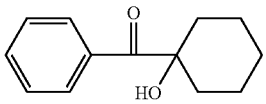

Compound II

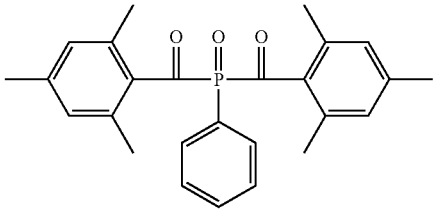

Compound III

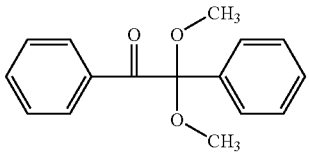

Compound I is available as Irgacure 184, compound II as Irgacure 819 and compound III as Irgacure 651.

The photoinitiator is preferably incorporated in the toner particles in a concentration range of 1-6% w/w based on the total weight of the toner particles.

The liquid developer composition of the present invention further comprises a coloring substance. In black-and-white printing, the coloring substance is usually an inorganic pigment which is preferably carbon black, but may also be, e.g. black iron (III) oxide. Inorganic colored pigments include, e.g., copper (II) oxide, chromium (III) oxide, milori blue, ultramarine, cobalt blue and barium permanganate. Examples of carbon black include lamp black, channel black and furnace black, e.g., SPEZIALSCHWARZ (IV) commercialized by Degussa and VULKAN XC 72 and CABOT REGAL 400 commercialized by Cabot.

Toners for the production of color images may contain organic coloring substances that may include dyes soluble in the binder resin or pigments including mixtures of dyes and pigments. Particularly useful organic coloring substances are selected from the group consisting of phthalocyanine dyes, quinacridone dyes, triaryl methane dyes, sulfur dyes, acridine dyes, azo dyes and fluoresceine dyes. A review of these dyes can be found in "Organic Chemistry" by Paul Karrer, Elsevier Publishing Company, Inc., New York, USA (1950).

In order to obtain wet toner particles with sufficient optical density in the spectral absorption region of the coloring substance, the coloring substance is preferably present therein in an amount of at least 1-50% w/w based on the total weight of the toner particles, more preferably in an amount of 5 to 50% w/w. The amount is selected such as to obtain the specified optical density in the final image.

The toner particles in the liquid developer composition of the present invention can comprise any other toner ingredient known to the skilled person, e.g. additives to fine tune melt properties and/or cohesivity at ambient temperature and/or mutual tack of images. For example, inorganic fillers, anti-slip agents, flowing agents, waxes, etc., can be employed. As inorganic fillers colloidal inorganic fillers such as colloidal silica, alumina, and/or titanium dioxide can be used in minor amounts.

In order to obtain toner particles having magnetic properties, a magnetic or magnetisable material in finely divided state is added during the production of the liquid developer composition.

Positive and negative charge generating compounds can be used in order to modify or improve the intrinsic chargeability in either negative or positive charge direction. The charge generating compound can be selected from salts of organic acids comprising a multivalent metal ion. The salts of organic acids can be selected for example from octoates, acrylsulfonates and alkylphosphates. The multivalent metal ions can be selected for example from $Mn^{2+}$, $Co^{2+}$, $Zn^{2+}$ and $Zr^{4+}$, $Zn^{2+}$ and/or $Zr^{4+}$ being particularly preferred.

To facilitate the dispersion of the toner particles in the dispersant a polymeric dispersing agent is added. The total amount of said polymeric dispersing agent should be not more than 100% w/w, preferably not more than 50% w/w based on the total weight of the toner particles in order to avoid a negative influence of the polymeric dispersing agent on the curing and cross-linking of the toner particles.

The polymeric dispersing agent should be selected such that it facilitates dispersing the toner particles in the dispersant and stabilizes the obtained dispersion. To achieve these goals the polymeric dispersing agent should show a sufficient solubility in the dispersant and at the same time a tendency to adsorb onto the surface of the toner particles. This can be realized either by the chemical composition and/or by the molecular structure and/or by the molecular weight of said polymeric dispersing agent. In a preferred embodiment of the present invention the polymeric dispersing agent comprises at least 25% w/w based on the total weight of the polymeric dispersing agent of monomer units that would show as corresponding homopolymer a solubility larger than 5% w/w in the dispersant at 20° C. and at least 10% w/w based on the total weight of the polymeric dispersing agent of monomer units that would show as corresponding homopolymer a solubility lower than 0.5% w/w in the dispersant at 20° C. For example, the polymeric dispersing agent may be selected from acrylic polymeric compounds, styrene-alkylene polymeric compounds and mixtures thereof.

Preferably, the toner particles in the liquid developer composition of the present invention have a glass transition temperature (Tg) of higher than 20° C., preferably higher than 40° C. and most preferably of higher than 45° C. The glass transition temperature is determined in accordance with ASTM D 3418-82.

Preferably the binder resin in the toner particles used in the liquid developer composition of the present invention has a softening temperature lower than 150° C., preferably lower than 125° C., most preferred lower than 120° C.

The toner particles in the liquid developer composition of the present invention should comprise at least 50% w/w of the binder resin based on the total weight of the toner particles. The binder resin may consist of one or more of the polymeric compounds having at least two ethylenically unsaturated groups. Alternatively, the binder resin may comprise other resins. However, in this case the binder resin should comprise at least 50% w/w of the polymeric compound having at least two ethylenically unsaturated groups based on the total weight of the binder resin.

The toner particles are dispersed in a dispersant which preferably is an insulating dispersant. Preferred dispersants are described for example in U.S. Pat. No. 5,998,075, the content of which is incorporated herein by reference. The dispersant preferably has a resistance in a range of about $10^{10}$ Ohm·m to $10^{15}$ Ohm·m, which does not disturb the electrostatic latent image. Preferably the liquid has a boiling point which allows easy drying or evaporation. Furthermore, it is preferable that the solvent admits no foul odor, is not poisonous, and has a relatively safe flammability point. Aliphatic hydrocarbons may be used as dispersant, or alicyclic hydrocarbons, polysiloxanes, or other carrier liquids, as well as mixtures thereof. Amongst these, paraffin solvents and isoparaffin solvents are preferable in view of odor, harmlessness, and costs. Examples of dispersants include Isopar G, H, L, M, K and V (each available from Exxon-Mobil). Other paraffin dispersants can be used. Norpar aliphatic fluids (also available from Exxon-Mobil) are more linear in structure and offer narrow molecular weight distributions, said fluids being characterized by a lower amount of volatile fractions. In case the solvating power of the dispersant towards the sterically stabilizing dispersant aids has to be increased use can be made of Exxsol or Varsol fluids. Also low molecular weight silicone oils can be used, such as the 200-series offered by Dow Chemicals. Said silicone oils offer low viscosity and at the same time low volatility. Alternative dispersants can also be used, said dispersants being safe from ecological and toxicological view, such as orange based terpenes.

Any suitable substrate can be used to print the curable liquid developer composition on. For example it can be paper, plastic and/or metal foils and combinations of them in different thicknesses.

The curing of the toner particles after a toner image has been formed on a substrate can proceed in-line, e.g. in the fusing station itself or in a station immediately adjacent to said fusing station. Alternatively the curing can proceed off-line in a separate apparatus wherein the fused layer of toner particles is heated again and e.g. UV-radiated. It is particularly preferred that the radiation (UV) curing process proceeds on the molten toner and particularly while the toner has some fluidity. Preferably the radiation curing proceeds at a temperature that preferably is at most 150° C. Therefore, it is preferred to use toner particles, comprising a radiation curable compound having a Tg of higher than 45° C. and that have a melt viscosity at 120° C. between 50 and 2000 Pa·s, preferably between 100 and 1500 Pa·s.

The present invention furthermore provides a method of preparing a liquid developer composition as defined above, the method comprising the steps of a) preparing a conglomerate comprising a binder resin comprising a polymeric composition being able to be cured by actinic radiation, an initiator, and a coloring substance, b) grinding said conglomerate c) dispersing said ground conglomerate in a dispersant, and d) further grinding said dispersion.

The conglomerate can be prepared by melting the binder resin and adding the initiator, the coloring substance and optionally other constituents to the melt. Alternatively the conglomerate can be prepared by melt-kneading the constituents, by extruding the constituents, or by dissolving the binder resin in a suitable solvent, adding the initiator, the coloring substance and optionally other constituents and removing the solvent.

It has surprisingly been found that by the method of the present invention a liquid developer composition is obtained wherein the binder resin forms a matrix for the initiator, the coloring substance, and, if present, the cross-linker, thus avoiding dissolution of these constituents in the dispersant despite the extremely small particle size of the toner particles.

In the first grinding step the conglomerate is preferably ground to a particle size of less than 1 mm. These still large particles are then dispersed in the dispersant and further ground to a particle size of the toner particles of less than 5 μm, preferably less than 3 μm. If necessary the upper size fraction of the particle size distribution can be removed after the final grinding step. Grinding can be carried out as described for example in U.S. Pat. No. 6,174,640.

The charge generating compound and/or the polymeric dispersing agent can be added before, during or after grinding the dispersion. Preferably, at least part of the polymeric dispersing agent is added before grinding the dispersion. Additional polymeric dispersing agent may be added after grinding the dispersion. The charge generating compound is preferably added before grinding the dispersion.

The preferred embodiments of the present invention are illustrated by but not limited to the following examples.

The following abbreviations are used in the Examples

Resins:

| | |
|---|---|
| UV1 | polyester based radiation curable composition |
| UV2 | urethane based radiation curable composition |
| E-1 | epoxy resin (non UV-curable) |

Dispersing Agents:

| | |
|---|---|
| IB18 | isobutyl-octadecylmethacrylate copolymer |
| SA | styrene-alkylene copolymer |

Charge Generating Agents:

| | |
|---|---|
| ZR | zirconium octoate |
| ZN | zinc alkylphosphate (n >= 8) |

PREPARATION EXAMPLE

Preparation of the Conglomerate (2)

172 g of resin UV1, 43 g of a carbon black pigment, 5.2 g of an UV-initiator (Irgacure 819) were mixed, and melt homogenized using a melt kneader at 120° C. for 30 minutes.

The melt homogenized mass is allowed to cool to room temperature and is crushed using a hammer mill to a particle size smaller than 1 mm.

Preparation of the Concentrated Liquid Developer (Example 1)

22 g of a conglomerate (2) is dispersed in 150 g of dispersant (Isopar G), 7.5 g of a dispersing agent (IB18) is added as well as 0.7 g of ZR. The dispersion is milled in a colloid mill equipped with glass spheres (approximately 2 mm diameter) for 8 hours. The temperature of the dispersion is kept below the Tg value of the conglomerate. After the milling process the glass spheres and coarse unground material are removed. The particle size was observed by microscope and was found to be in the range of 0.5-5 μm. The concentrated liquid developer (Example 1) was diluted to a concentration suitable for processing in the electrophotographic engine.

The crosslinking of the liquid developer composition was excellent.

The following examples and comparative examples were prepared in accordance with the above described preparations. In Table 2 the crosslinking of the liquid developer is rated for each example as excellent (++), good (+) and no crosslinking (–).

TABLE 1

Preparation of the conglomerate:

| | Resins | Coloring substance | Photoinitiator |
|---|---|---|---|
| Conglomerate (1) | 172 g E-1 | 88 g carbon black | no |
| Conglomerate (2) | 172 g UV1 | 43 g carbon black | 5.2 g Irgacure 819 |
| Conglomerate (3) | 172 g UV1 | 60 g carbon black | 5.2 g Irgacure 819 |
| Conglomerate (4) | 172 g UV1 | 43 g phthalocyanine pigment | 5.2 g Irgacure 819 |
| Conglomerate (5) | 172 g UV1 | 43 g carbon black | 5.2 g Irgacure 184 |

TABLE 1-continued

Preparation of the conglomerate:

| | Resins | Coloring substance | Photoinitiator |
|---|---|---|---|
| Conglomerate (6) | 115 g UV1 and 57 g E-1 | 43 g carbon black | 5.2 g Irgacure 819 |
| Conglomerate (7) | 172 g UV2 | 43 g carbon black | 5.2 g Irgacure 819 |
| Conglomerate (8) | 172 g UV1 | 43 g carbon black | 7.7 g Irgacure 819 |

TABLE 2

Preparation of the concentrated liquid developer:

| | Conglomerate | Dispersing agent | Charge generating compound | Dispersant | Crosslinking |
|---|---|---|---|---|---|
| Comparative Example | 22 g Conglomerate (1) | 7.5 g IB18 | 0.7 g ZR | 150 g Hydrocarbon | – |
| Example 1 | 22 g Conglomerate (2) | 7.5 g IB18 | 0.7 g ZR | 150 g Hydrocarbon | ++ |
| Example 2 | 22 g Conglomerate (3) | 7.5 g IB18 | 0.7 g ZR | 150 g Hydrocarbon | + |
| Example 3 | 22 g Conglomerate (4) | 7.5 g IB18 | 0.7 g ZR | 150 g Hydrocarbon | ++ |
| Example 4 | 22 g Conglomerate (2) | 15 g IB18 | 0.7 g ZR | 150 g Hydrocarbon | + |
| Example 5 | 22 g Conglomerate (2) | 1 g SA | 0.06 g ZN | 150 g Hydrocarbon | ++ |
| Example 6 | 22 g Conglomerate (5) | 7.5 g IB18 | 0.7 g ZR | 150 g Hydrocarbon | + |
| Example 7 | 22 g Conglomerate (6) | 7.5 g IB18 | 0.7 g ZR | 150 g Hydrocarbon | + |
| Example 8 | 22 g Conglomerate (7) | 7.5 g IB18 | 0.7 g ZR | 150 g Hydrocarbon | ++ |
| Example 9 | 22 g Conglomerate (8) | 7.5 g IB18 | 0.7 g ZR | 150 g Hydrocarbon | ++ |

The invention claimed is:

1. A liquid developer composition, comprising a dispersant, a polymeric dispersing agent, and solid toner particles dispersed in said dispersant, wherein the solid toner particles comprise a binder resin comprising a polymeric composition curable by actinic radiation, said polymeric composition selected from the group consisting of UV curable epoxy resins and polyester resins having at least two ethylenically unsaturated groups, an initiator, and a coloring substance, further wherein the constituents of the solid toner particles are substantially insoluble in the dispersant.

2. The liquid developer composition according to claim 1, wherein the binder resin forms a matrix and the initiator and the coloring substance are dispersed throughout said matrix.

3. The liquid developer composition according to claim 1, wherein said liquid developer composition additionally comprises a charge generating compound.

4. The liquid developer composition according to claim 3, wherein the charge generating compound is selected from the group consisting of salts of organic acids comprising a multivalent metal ion.

5. The liquid developer composition according to claim 4, wherein the charge generating compound is a salt of an organic acid comprising a multivalent metal ion selected from the group consisting of $Zn^{2+}$ and $Zr^{4+}$.

6. The liquid developer composition according to claim 1, wherein the polymeric composition curable by actinic radiation is selected from the group consisting of (meth)acrylate containing polyesters and a polyester-urethaneacrylate polymer.

7. The liquid developer composition according to claim 1, wherein the initiator is a photoinitiator.

8. The liquid developer composition according to claim 7, wherein the photoinitiator can be activated by UV-radiation.

9. The liquid developer composition according to claim 1, wherein the dispersant is an electrically low-conductive liquid having a low solving power towards the constituents of the solid toner particles.

10. The liquid developer composition according to claim 1, wherein the polymeric dispersing agent is present in an amount of not more than 100% w/w, based on the total weight of the toner particles.

11. The liquid developer composition according to claim 10, wherein the polymeric dispersing agent is present in an amount of not more than 50% w/w based on the total weight of the toner particles.

12. The liquid developer composition according to claim 1, wherein the polymeric dispersing agent is selected from the group consisting of acrylic polymeric compounds, styrene-alkylene polymeric compounds and mixtures thereof.

13. The liquid developer composition according to claim 1, wherein the solid toner particles have a glass transition temperature (Tg) of higher than 20° C.

14. The liquid developer composition according to claim 13, wherein the solid toner particles have a glass transition temperature (Tg) higher than 45° C.

15. The liquid developer composition according to claim 1, wherein the solid toner particles comprise at least 50% w/w of the binder resin based on the total weight of the toner particles.

16. The liquid developer composition according to claim 1, wherein the binder resin comprises at least 50% w/w of the polymeric composition curable by actinic radiation based on the total weight of the binder resin.

17. The liquid developer composition according to claim 16, wherein the binder resin comprises at least 75% w/w of the polymeric composition curable by actinic radiation based on the total weight of the binder resin.

18. A method of preparing the liquid developer composition of claim 1, the method comprising the steps of a) preparing a conglomerate comprising: a binder resin comprising a polymeric composition curable by actinic radiation, an initiator, and a coloring substance, b) grinding said conglomerate, c) dispersing said ground conglomerate in a dispersant, and d) further grinding said dispersion.

19. The method according to claim 18 wherein the conglomerate is prepared my melting the binder resin and adding the initiator, the coloring substance and optionally other constituents to the melt, melt kneading the constituents, extruding the constituents, or dissolving the binder resin in a suitable solvent, adding the initiator, the coloring substance and optionally other constituents and removing the solvent.

20. The method according to claim 18, wherein the conglomerate is ground to a particle size of less than 1 mm.

21. The method according to claim 18, wherein a charge generating compound and/or a polymeric dispersing agent is added before, during or after grinding the dispersion.

22. The method according to claim 18, wherein the dispersion is ground to obtain solid toner particles having a particle size of less than 5 μm.

23. The method according to claim 22, wherein the dispersion is ground to obtain solid toner particles having a particle size of less than 3 μm.

24. A liquid developer composition obtained by the method of claim 18.

* * * * *

UNITED STATES PATENT AND TRADEMARK OFFICE

CERTIFICATE OF CORRECTION

PATENT NO. : 8,501,381 B2
APPLICATION NO. : 12/531919
DATED : August 6, 2013
INVENTOR(S) : Hans-Josef Humpert et al.

It is certified that error appears in the above-identified patent and that said Letters Patent is hereby corrected as shown below:

On the Title page, at item (73) Assignee, please replace the word "Hologi" with -- Hologic -- so as to read "Hologic Hitec-Imaging GmbH".

Signed and Sealed this
Twenty-second Day of October, 2013

Teresa Stanek Rea

Teresa Stanek Rea
*Deputy Director of the United States Patent and Trademark Office*